US006273280B1

(12) United States Patent
Markarian

(10) Patent No.: US 6,273,280 B1
(45) Date of Patent: Aug. 14, 2001

(54) CLOTHES HANGER ORGANIZER

(76) Inventor: Jean Markarian, 2416 Baggett Dr., Santa Rosa, CA (US) 95401

( * ) Notice: Subject to any disclaimer, the term of this patent is extended or adjusted under 35 U.S.C. 154(b) by 0 days.

(21) Appl. No.: 09/538,650

(22) Filed: Mar. 30, 2000

Related U.S. Application Data

(60) Provisional application No. 60/131,460, filed on Apr. 28, 1999.

(51) Int. Cl.[7] ..... A47F 5/00

(52) U.S. Cl. ..... 211/113; 211/119; D6/315; D6/513

(58) Field of Search ..... D6/513, 315; 211/113, 211/118, 119

(56) References Cited

U.S. PATENT DOCUMENTS

| | | | | |
|---|---|---|---|---|
| D. 264,904 | | 6/1982 | Helbig . | |
| D. 378,167 | | 2/1997 | Jones, Jr. . | |
| 2,480,327 | * | 8/1949 | Idelsohn . | |
| 2,601,926 | * | 7/1952 | Speaker et al. . | |
| 2,972,419 | * | 2/1961 | Zelen et al. . | |
| 3,187,904 | * | 6/1965 | Kiechle . | |
| 3,887,079 | | 6/1975 | Crew . | |
| 3,961,710 | | 6/1976 | Creamer . | |
| 4,308,962 | | 1/1982 | Fahmi . | |
| 4,518,089 | * | 5/1985 | Campbell | 211/118 |
| 4,893,715 | * | 1/1990 | Papazian et al. | 211/118 |
| 5,076,446 | * | 12/1991 | Summerman et al. | 211/113 |
| 5,188,241 | * | 2/1993 | Kodoza et al. | 211/113 X |
| 5,515,981 | | 5/1996 | Gregory et al. . | |
| 5,524,948 | | 6/1996 | Bostwick . | |
| 6,065,613 | * | 5/2000 | Gusdorf et al. | 211/119 X |

* cited by examiner

*Primary Examiner*—Robert W. Gibson, Jr.
(74) *Attorney, Agent, or Firm*—Jack Lo

(57) ABSTRACT

The present clothes hanger organizer comprises a pair of vertical rods connected by a plurality of horizontal rods. Hooks at the top of the vertical rods are for hanging on a hanger rod in a closet. The horizontal rods are for supporting a plurality of extra clothes hangers several layers deep for conserving space on the hanger rod. Different styles of clothes hangers can be organized by hanging from different horizontal rods.

1 Claim, 1 Drawing Sheet

CLOTHES HANGER ORGANIZER

CROSS REFERENCE TO RELATED APPLICATIONS

The benefit of provisional application No. 60/131,460 filed Apr. 28, 1999 is claimed.

BACKGROUND OF THE INVENTION

1. Field of the Invention

This invention relates generally to clothes hangers.

2. Prior Art

Most people have relatively full closets. Having a supply of extra clothes hangers is handy for hanging new clothes. However, putting the extra hangers on the hanger rod takes up the precious little space that can be otherwise used for hanging clothes. Also, there are different styles of hangers for different types of clothing. When these different hangers are all put on the same hanger rod, they are mixed up in an unorganized arrangement.

OBJECTIVES OF THE INVENTION

Accordingly, the objectives of the present clothes hanger organizer are:

- to store extra clothes hangers in a minimum of space on a hanger rod;
- to leave room on the hanger rod for hanging clothes; and
- to organize different styles of hangers so they are easier to find.

Further objectives of the present invention will become apparent from a consideration of the drawings and ensuing description.

BRIEF SUMMARY OF THE INVENTION

The present clothes hanger organizer comprises a pair of vertical rods connected by a plurality of horizontal rods. Hooks at the top of the vertical rods are for hanging on a hanger rod in a closet. The horizontal rods are for supporting a plurality of extra clothes hangers several layers deep for conserving space on the hanger rod. Different styles of clothes hangers can be organized by hanging from different horizontal rods.

Figure 1:
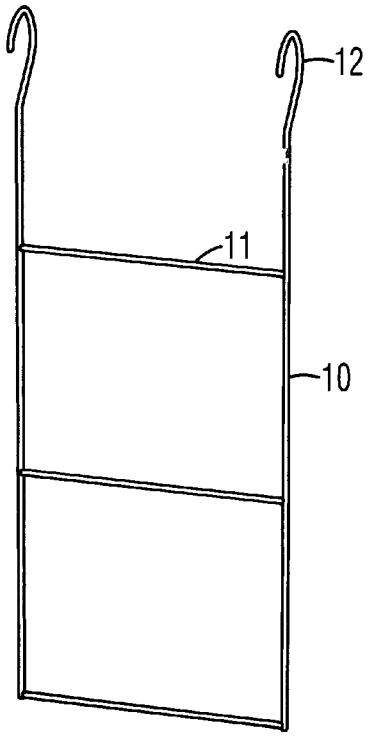
FIG. 1 is a front perspective view of the present clothes hanger organizer.

| DRAWING REFERENCE NUMERALS |
|---|
| 10. Vertical Rods |
| 11. Horizontal Rods |
| 12. Hooks |
| 13. Hanger Rod |
| 14. Clothes Hangers |

DETAILED DESCRIPTION OF THE INVENTION

FIG. 1:

A preferred embodiment of the present clothes hanger organizer is shown in a front perspective view in FIG. 1. It comprises a pair of vertical rods 10 connected by a plurality of horizontal rods 11 Hooks 12 at the top of vertical rods 10 are each arranged on a plane perpendicular to horizontal rods 11. The highest horizontal rod 11 is spaced below the top of hooks 12 a distance generally identical to a distance separating adjacent horizontal rods 11. Any number of horizontal rods 11 may be provided, but preferably at least two.

Figure 2:
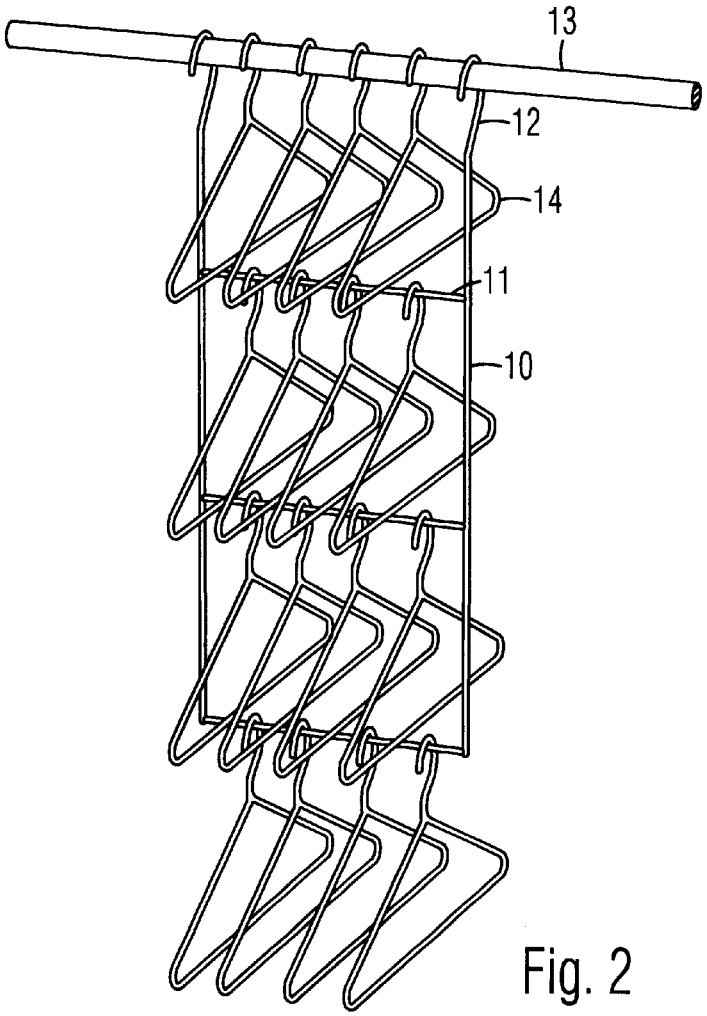
FIG. 2 is a front perspective view of the organizer in use.

FIG. 2:

In FIG. 2, the organizer is hung on a conventional hanger rod 13. Horizontal rods 11 are parallel to hanger rod 13. A plurality of unused, extra clothes hangers 14 are hung on horizontal rods 11 several layers deep to conserve space on hanger rod 13. Additional clothes hangers are also hung on hanger rod 13 between hooks 12. Many extra clothes hangers can thus be hung on the organizer in a minimum of space on hanger rod 13 to leave room for clothes. The highest horizontal rod 11 is spaced below hooks 12 and hanger rod 13 a distance greater than the height of a clothes hanger to avoid interfering with the top layer of clothes hangers above. Different styles of clothes hangers can be organized by hanging from different horizontal rods 11. The hangers on horizontal rods 11 are parallel to the hangers on hanger rod 13 for compactness.

SUMMARY AND SCOPE

Accordingly, the present clothes hanger organizer stores extra clothes hangers in a minimum of space on a hanger rod. It leaves room on the hanger rod for hanging clothes. It also organizes different styles of hangers so they are easier to find.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A method for compactly storing unused clothes hangers, comprising the steps of:

providing an organizer comprising two vertical rods with hooks at respective top ends thereof, a plurality of horizontal rods connected between said vertical rods, wherein said horizontal rods are spaced from each other a distance greater than a height of said unused clothes hangers, and a top one of said horizontal rods is spaced below top ends of said hooks said distance greater than said height of said clothes hangers;

hanging said hooks of said organizer on a closet hanger rod in a closet;

hanging said unused clothes hangers on each of said horizontal rods; and hanging additional unused clothes hangers on said closet hanger rod between said hooks of said organizer.

* * * * *